US012305939B2

(12) United States Patent
Han et al.

(10) Patent No.: US 12,305,939 B2
(45) Date of Patent: May 20, 2025

(54) HEAT EXCHANGER HAVING FLOW DISTRIBUTION TANK STRUCTURE FOR THERMAL STRESS DISPERSION

(71) Applicant: Hanon Systems, Daejeon (KR)

(72) Inventors: Ji Hun Han, Daejeon (KR); Jungbum Choi, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 391 days.

(21) Appl. No.: 17/798,357

(22) PCT Filed: Feb. 16, 2021

(86) PCT No.: PCT/KR2021/001968

§ 371 (c)(1),
(2) Date: Aug. 9, 2022

(87) PCT Pub. No.: WO2021/167320

PCT Pub. Date: Aug. 26, 2021

(65) Prior Publication Data

US 2023/0082035 A1 Mar. 16, 2023

(30) Foreign Application Priority Data

Feb. 19, 2020 (KR) ..... 10-2020-0020056
Feb. 10, 2021 (KR) ..... 10-2021-0019251

(51) Int. Cl.
*F28F 9/02* (2006.01)
*F28D 1/053* (2006.01)
(Continued)

(52) U.S. Cl.
CPC ..... *F28F 9/0263* (2013.01); *F28D 1/053* (2013.01); *F28F 1/02* (2013.01); *F28F 9/26* (2013.01)

(58) Field of Classification Search
CPC ... F28F 9/0263; F28F 1/02; F28F 9/26; F28D 1/053
(Continued)

(56) References Cited

U.S. PATENT DOCUMENTS 5,107,926 A * 4/1992 Calleson ..... F28F 9/0214 165/173
5,152,339 A * 10/1992 Calleson ..... F28F 21/084 165/173
(Continued)

FOREIGN PATENT DOCUMENTS

CN 108369078 A 8/2018
CN 109154480 A 1/2019
(Continued)

OTHER PUBLICATIONS

German Examination Report issued on Mar. 28, 2024 in corresponding application No. DE 11 2021 001 086.7, with English translation.

*Primary Examiner* — Claire E Rojohn, III
(74) *Attorney, Agent, or Firm* — NORTON ROSE FULBRIGHT US LLP

(57) ABSTRACT

The present invention relates to a heat exchanger having a flow distribution tank structure for thermal stress dispersion. The objective of the present invention is to provide an integrated heat exchanger for cooling two types of heat exchange media having different temperatures, the heat exchanger having a flow distribution tank structure for thermal stress dispersion, and having a flow distribution structure in a tack so as to effectively disperse the thermal stress caused by the temperature difference.

9 Claims, 11 Drawing Sheets

(51) Int. Cl.
*F28F 1/02* (2006.01)
*F28F 9/26* (2006.01)

(58) Field of Classification Search
USPC ..... 165/173
See application file for complete search history.

(56) References Cited

U.S. PATENT DOCUMENTS 6,364,005 B1 * 4/2002 Makino ..... F28F 9/0251 165/173
6,374,632 B1 * 4/2002 Nobuta ..... F25B 39/04 62/509
6,446,713 B1 * 9/2002 Insalaco ..... F28F 9/0224 165/173
6,736,203 B2 * 5/2004 Rhodes ..... F28D 1/0435 165/173
7,775,267 B2 * 8/2010 Higashiyama ..... F28F 17/005 165/173
7,779,893 B2 * 8/2010 Leitch ..... F28F 9/0226 165/173
7,886,811 B2 * 2/2011 Higashiyama ..... F28F 9/0246 165/173
11,732,979 B2 * 8/2023 Riondet ..... F28F 9/0226 165/175
2003/0085030 A1 * 5/2003 Gowan ..... F28F 9/0212 165/173
2006/0213651 A1 * 9/2006 Higashiyama ..... F28D 1/05391 165/173
2007/0209787 A1 * 9/2007 Hiyama ..... F28F 9/0246 165/178
2008/0164015 A1 * 7/2008 Papapanu ..... F28F 9/0263 165/176
2009/0065183 A1 * 3/2009 Uneno ..... F28F 1/04 165/173
2009/0173102 A1 * 7/2009 Ogasawara ..... F28D 1/05375 165/173
2009/0282850 A1 * 11/2009 Higashiyama ..... F28F 1/128 165/181
2010/0031698 A1 * 2/2010 Higashiyama ..... F28D 1/05391 62/526
2010/0032149 A1 * 2/2010 Roll ..... F28F 9/182 165/173
2011/0168372 A1 * 7/2011 Takahashi ..... F28F 9/0226 165/173
2011/0220336 A1 * 9/2011 Saito ..... F28F 9/0217 165/173
2011/0303401 A1 * 12/2011 Kamoshida ..... F28D 1/05391 165/173
2012/0138282 A1 * 6/2012 Foerster ..... F28D 1/05366 165/173
2012/0227946 A1 * 9/2012 Kent ..... F25B 43/003 165/173
2012/0247742 A1 * 10/2012 Mizuno ..... F28D 1/05391 165/173
2012/0305228 A1 * 12/2012 Arino ..... F28D 1/05391 165/173
2013/0213624 A1 * 8/2013 Fujii ..... F28F 1/126 165/172
2014/0069136 A1 * 3/2014 Lim ..... B60H 1/00778 62/436
2014/0360705 A1 * 12/2014 Kim ..... F28F 1/126 165/140
2015/0285544 A1 * 10/2015 Baba ..... F28F 9/26 165/104.21
2015/0377558 A1 * 12/2015 Han ..... F28F 1/045 165/151
2016/0131430 A1 * 5/2016 Mazzoni ..... F28F 9/0282 165/174
2016/0138871 A1 * 5/2016 Matsumoto ..... F28F 9/028 62/526
2017/0050489 A1 * 2/2017 Naitou ..... B60H 1/00328
2018/0306517 A1 * 10/2018 Ramakrishan ..... F28D 1/05383
2019/0137152 A1 * 5/2019 Akiyoshi ..... F28F 9/22
2020/0224580 A1 * 7/2020 Usuki ..... F28D 1/05366
2020/0256627 A1 * 8/2020 Armsden ..... F28F 9/0263
2020/0271398 A1 * 8/2020 Choi ..... F28D 1/0443
2020/0292249 A1 * 9/2020 Inagaki ..... F28F 1/128
2022/0099387 A1 * 3/2022 Maquin ..... F28F 9/0263
2022/0282938 A1 * 9/2022 Komuro ..... F28D 1/0443
2023/0082035 A1 * 3/2023 Han ..... F28F 1/02 165/173
2023/0092584 A1 * 3/2023 Tarui ..... F25B 39/02 165/153
2023/0168039 A1 * 6/2023 Han ..... F28F 1/025 165/175
2023/0280112 A1 * 9/2023 Komuro ..... F28D 1/05366 165/175
2023/0366630 A1 * 11/2023 Han ..... F28F 9/0226
2024/0102745 A1 * 3/2024 Lim ..... F28F 9/16
2024/0280335 A1 * 8/2024 Han ..... F28F 9/0226

FOREIGN PATENT DOCUMENTS

EP 3336477 A1 6/2018
JP H10206078 A 8/1998
JP 2001215096 A 8/2001
JP 2017096591 A 6/2017
KR 19980061905 A 10/1998
KR 20050104763 A 11/2005
KR 20100035268 A 4/2010
KR 20130023450 A 3/2013

* cited by examiner

HEAT EXCHANGER HAVING FLOW DISTRIBUTION TANK STRUCTURE FOR THERMAL STRESS DISPERSION

CROSS REFERENCE TO RELATED APPLICATIONS

This application is a national phase under 35 U.S.C. § 371 of International Application No. PCT/KR2021/001968 filed on Feb. 16, 2021, which claims the benefit of priority from Korean Patent Application Nos. 10-2021-0019251 filed on Feb. 10, 2021 and 10-2020-0020056 filed on Feb. 19, 2020. The entire contents of these applications are incorporated herein by reference in their entirety.

TECHNICAL FIELD

The present invention relates to a heat exchanger, and more particularly, to an integrated heat exchanger for cooling two types of heat exchange media having different temperatures by having a flow distribution structure in a tank to effectively disperse thermal stress caused by a temperature difference.

BACKGROUND ART

In general, an engine room of a vehicle may be provided with not only components for driving the vehicle, such as an engine, but also various heat exchangers such as a radiator, an intercooler, an evaporator and a condenser for cooling the respective components in the vehicle, such as the engine or for adjusting an air temperature of a vehicle interior. In general, these heat exchangers may each have a heat exchange medium circulating therein, and the heat exchange medium in the heat exchanger and air outside the heat exchanger may exchange heat with each other, thereby achieving cooling or heat dissipation.

In many cases, one type of heat exchange medium may circulate in the heat exchanger. However, when necessary, heat exchangers may be integrally formed with each other for two types of heat exchange media to circulate therein. For example, in cases of the radiator and oil cooler of an automobile, coolant for cooling the engine may circulate in the radiator, and oil such as engine oil and transmission oil may circulate in the oil cooler. In some cases, these components may be formed as separate devices. However, in many cases, these components may be formed integrally with each other for increasing space usability of the engine room, or when introducing a water-cooled oil cooler structure in which the coolant is used to cool the oil, etc.

FIG. 1 shows an exemplary embodiment of a conventional integrated heat exchanger in which two types of heat exchange media circulate. The integrated heat exchanger according to an exemplary embodiment of FIG. 1 may have a structure almost similar to that of the heat exchanger in which one type of heat exchange medium circulates. That is, a heat exchanger 1000 may include a pair of header tanks 100 positioned in parallel to each other while being spaced apart from each other, a plurality of tubes 200 each having both ends fixed to the header tanks 100 to form a flow path of a refrigerant, and further include a plurality of fins 300 interposed between the tubes 200. In addition, the heat exchanger may include a baffle for partitioning and separating an inner space of the header tank 100 or the header tank 100 itself may be divided so that two types of heat exchange media circulate without being mixed with each other. FIG. 1 shows an exemplary embodiment in which the header tank 100 is divided. In addition, unlike the heat exchanger in which one type of heat exchange medium circulates has one inlet/outlet, the heat exchanger in which two types of heat exchange media circulate may have two inlets/outlets.

Meanwhile, it is considered that this integrated heat exchanger replaces two heat exchangers with one heat exchanger in a word. Therefore, compared to the case of two heat exchangers, a heat exchanger core (or a core, which includes tubes and fins and is a zone where heat exchange is mainly performed) may have a reduced area, and it is thus necessary to further improve a heat exchange performance. According to this need, in the case of such an integrated heat exchanger, in some cases, the tube may have a partition wall formed in the middle so that the heat exchanger core is double-formed. The lower part of FIG. 1 shows a cross-sectional view of the tube having the partition wall formed in the middle. A shape of the tube having the partition wall formed in the middle may be manufactured using an extrusion method or may be manufactured using a folding method as shown in the lower part of FIG. 1. As a folded tube, an example of the tube having the partition wall formed in the middle is clearly shown in Korean Patent Laid-Open Publication No. 10-2013-0023450 (entitled "heat exchanger," and published on Mar. 8, 2013).

That is, the heat exchanger core may be separated into two in up and down directions, two types of heat exchange media may circulate therein, respectively, and upper and lower cores may also be separated into two in front and rear directions. In short, the upper and lower cores may not communicate with each other, and the front and rear cores may communicate with each other.

The integrated heat exchanger formed in this way may be operated in various ways, for example, two types of heat exchange media of different kinds such as coolant/oil may circulate therein, or two types of heat exchange media having different temperature ranges such as low temperature coolant/high temperature coolant circulate therein. In any case, a significant temperature difference may occur between the upper and lower cores when two types of heat exchange media circulate. Meanwhile, a temperature difference may also occur between the front and rear cores, which is described in detail as follows. The heat exchanger may allow the heat exchange media in the heat exchanger to exchange heat with outside air while the outside air circulates in the front and back directions. Here, when the core is double-formed in the front and rear directions due to the tube having the partition wall formed therein, air that already exchanged heat with the front core may exchange heat with the rear core. Accordingly, the temperature difference may also occur between the front and rear cores.

When a temperature distribution is unbalanced as such, a degree of thermal deformation may vary depending on a location, and a thermal stress may thus be concentrated on a specific portion of the heat exchanger. In the case of the integrated heat exchanger as described above, the concentration of thermal stress may be greatest in a portion where the upper and lower cores and the front and rear cores are divided. The concentration of thermal stress due to such thermal deformation may be a major cause of damage or crack of the heat exchanger, and there is a need for a design to solve this problem.

RELATED ART DOCUMENT

Patent Document

1. Korean Patent Laid-Open Publication No. 10-2013-0023450 (entitled "heat exchanger," and published on Mar. 8, 2013)

DISCLOSURE

Technical Problem

An object of the present invention is to provide a heat exchanger having a flow distribution tank structure for thermal stress dispersion, that is, an integrated heat exchanger for cooling two types of heat exchange media having different temperatures by having a flow distribution structure in a tank to effectively disperse thermal stress caused by a temperature difference.

Technical Solution

In one general aspect, a heat exchanger 1000 having a flow distribution tank structure for thermal stress dispersion includes a pair of header tanks 100 each including a header 110 and a tank 120 combined to each other, and positioned in parallel to each other while being spaced apart from each other by a predetermined distance; and a plurality of tubes 200 each having both ends fixed to the header tank 100 to form a flow path of a refrigerant, wherein when a direction in which outside air blows in is referred to as a front direction and a direction in which the outside air blows out is referred to as a rear direction, and when one of an extension direction of the header tank 100 is referred to as a first direction and the other is referred to as a second direction, in the heat exchanger 1000, an inner space of the header tank 100 is partitioned and separated in the first and second directions to allow heat exchange media having different average temperatures to respectively circulate in first-and-second direction heat exchange portions, and an inner space of the tube 200 is partitioned and separated into front and rear sides to have a heat exchange portion double-formed in the front and rear directions, and a flow distribution structure is positioned in the tank 120 for a flow of a heat exchange medium circulating to an inner space of the rear side of the tube 200 to be relatively less than a flow of a heat exchange medium circulating to an inner space of the front side of the tube 200.

Here, the flow distribution structure may be a combination of a flow adjustment rib 122 and a flow adjustment baffle 121 for reducing the flow of the heat exchange medium circulating to the inner space of the rear side of the tube 200 by including the flow adjustment rib 122 formed by a portion of the tank 120 protruding into the header tank 100 in a height direction of the header tank 100 and an end of the protrusion spaced apart from the inner space of the rear side of the tube 200, and the flow adjustment baffle 121 extending in the height direction of the header tank 100 and having one end fixed to an inner surface of the flow adjustment rib 122 and the other end spaced apart from the inner space of the rear side of the tube 200.

In addition, here in the flow distribution structure, the number of the tubes 200 in which the flow reduced by the flow adjustment baffle 121 may be less than or equal to the number of the tubes 200 in which the flow is reduced by the flow adjustment rib 122.

In addition, here, the flow distribution structure may be a separation structure for partitioning and separating the inner space of the header tank 100 at a boundary point of the first-and-second direction heat exchange portions of the tank 120 in the first and second directions, the number of the tubes 200 in which the flow is reduced by the flow adjustment baffle 121 may be less than the number of the tubes 200 in which the flow is reduced by the flow adjustment rib 122, and the flow adjustment baffle 121 may be positioned adjacent to the separation structure.

Alternatively, the flow distribution structure may be a flow adjustment rib 122 formed by a portion of the tank 120 protruding into the header tank 100 in a height direction of the header tank 100 and an end of the protrusion spaced apart from the inner space of the rear side of the tube 200 to reduce the flow of the heat exchange medium circulating to the inner space of the rear side of the tube 200.

Alternatively, the flow distribution structure may be a flow adjustment baffle 121 extending in a height direction of the header tank 100 and having one end fixed to an inner surface of the tank 120 and the other end spaced apart from the inner space of the rear side of the tube 200 to reduce the flow of the heat exchange medium circulating to the inner space of the rear side of the tube 200.

In addition, the tank 120 may include the separation structure for partitioning and separating the inner space of the header tank 100 at the boundary point of the first-and-second direction heat exchange portions in the first and second directions, and the separation structure may be either a separation rib formed by a portion of the tank 120 protruding into the header tank 100 in the height direction of the header tank 100 and the end of the protrusion in contact with the tube 200, or a separation baffle extending in the height direction of the header tank 100 and having one end fixed to the inner surface of the tank 120 and the other end in contact with the tube 200.

In addition, when the flow distribution structure includes the flow adjustment rib 122, and the separation structure is the separation rib, the flow adjustment rib 122 and the separation rib may be connected to each other.

In addition, the flow distribution structure may be positioned adjacent to a portion of the tube 200, through which the heat exchange medium is discharged.

In addition, the flow distribution structure may be positioned in any position of the tube 200 or may be positioned in a certain position of the tube 200 in a vicinity of the boundary point of the first-and-second direction heat exchange portions.

Here, the flow distribution structure may be positioned in the certain position of the tube 200 in the vicinity of the boundary point of the first-and-second direction heat exchange portions, and the vicinity of the boundary point of the first-and-second direction heat exchange portions may range from one to five positions with respect to a dummy tube 210, which is positioned in the boundary point of the first-and-second direction heat exchange portions of the heat exchanger 1000, in the first and second directions.

In addition, the tube 200 may include a partition wall partitioning and separating the inner space of the tube 200 into the front and rear sides by bending a plate.

In addition, the heat exchanger 1000 may be a radiator in which high-temperature coolant and low-temperature coolant circulate.

Advantageous Effects

According to the present invention, the integrated heat exchanger for cooling two types of heat exchange media having different temperatures may have the flow distribution structure formed in the tank to effectively disperse the thermal stress caused by the temperature difference. In more detail, the heat exchanger of the present invention may include the core divided into the first and second directions to cool two types of heat exchange media, and divided into the front and rear sides by using the tube having the partition wall in the middle, such as a folded tube, to have the improved heat exchange performance. Here, it is known that the most severe concentration of the thermal stress may occur on the points where the first and second directions are divided from each other and the front and rear sides are divided from each other, and on the corresponding point of the rear side among these points. Here, the present invention may relieve the concentration of the thermal stress by allowing the heat exchange medium of more flow to circulate in the front side of the tube, and the heat exchange medium of less flow to circulate in the rear side of the tube, and this flow distribution may be implemented using a baffle or a tank depression, positioned in the tank.

In this way, the present invention including the flow distribution structure may allow more heat exchange medium circulating in the front side of the tube to exchange heat with outside air that has yet to exchange heat, and less heat exchange medium circulating in the rear side of the tube to exchange heat with outside air that already exchanged heat once in the front core, which may remarkably solve the temperature unbalance problem. It is thus possible to effectively disperse the thermal stress, and ultimately significantly reduce the damage and crack problems in the connection between the header and the tube.

Figure 1:
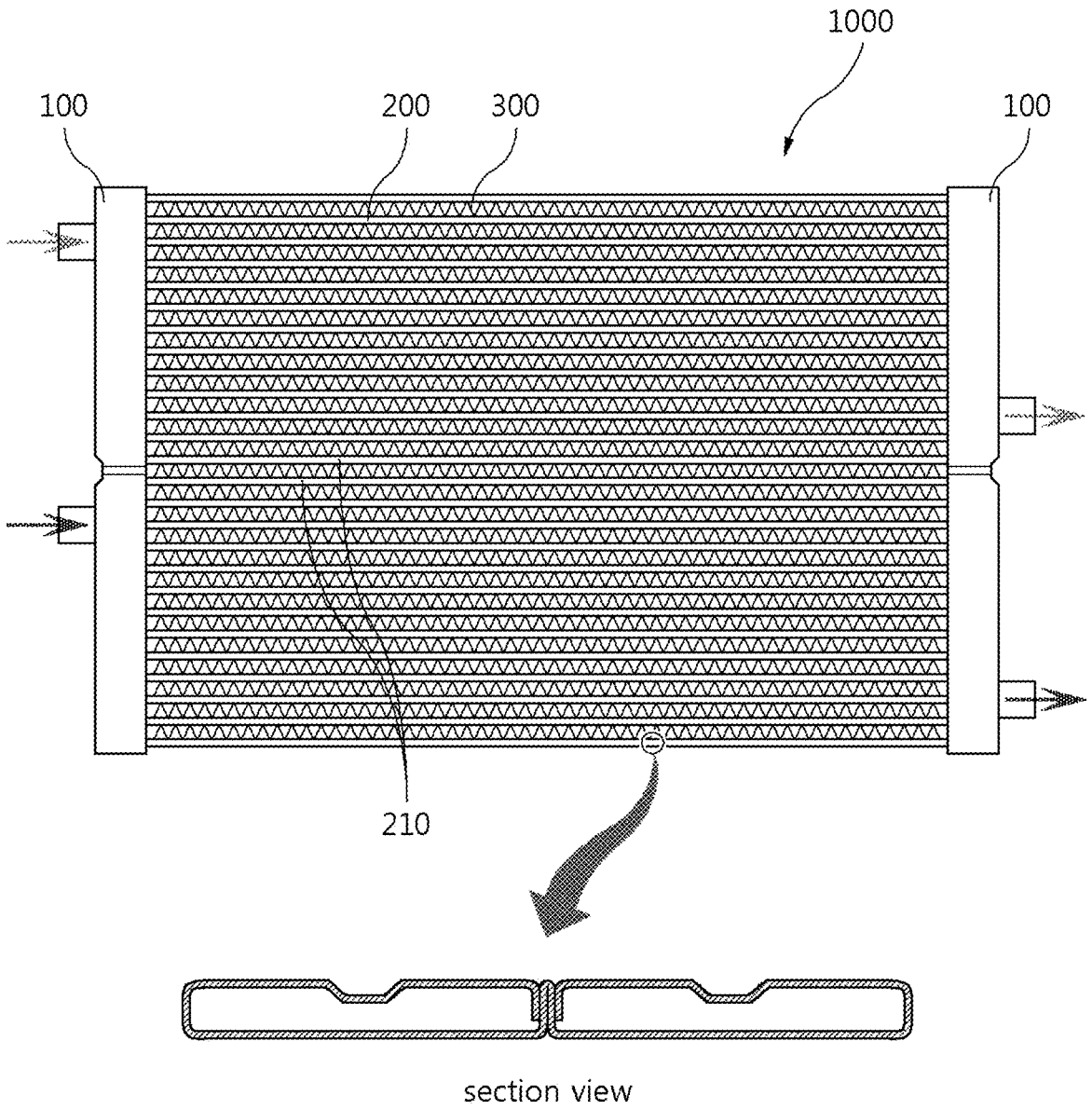
FIG. 1 shows an exemplary embodiment of a conventional integrated heat exchanger in which two types of heat exchange media circulate.

| ** Description of Reference Numerals ** | |
|---|---|
| 1000: heat exchanger | |
| 100: header tank | |
| 110: header | 120: tank |
| 121: flow adjustment baffle | 122: flow adjustment rib |
| 200: tube | 210: dummy tube |
| 300: fin | |

BEST MODE

Hereinafter, a heat exchanger having a flow distribution structure for thermal stress dispersion according to the present invention, which has the above-described configuration, is described in detail with reference to the accompanying drawings.

The heat exchanger disclosed in the present invention may be an integrated heat exchanger in which two types of heat exchange media having different temperatures separately circulate, and in particular, a heat exchanger in which a tube has two rows, i.e. front and rear sides, and a core, i.e. a heat exchange portion where heat exchange mainly occurs, is double-formed in first and second directions as well as front and rear directions. In detail, as briefly described above with reference to FIG. 1, a heat exchanger 1000 may include a pair of header tanks 100 each including a header 110 and a tank 120 combined to each other to have a housing shape, and positioned in parallel to each other while being spaced apart from each other by a predetermined distance; and a plurality of tubes 200 each having both ends fixed to the header tank 100 to form a flow path of a refrigerant, and may further include a plurality of fins 300 interposed between the tubes 200. Here, when one of an extension direction of the header tank 100 is referred to as the first direction and the other is referred to as the second direction, in the heat exchanger 1000, an inner space of the header tank 100 may be partitioned and separated in the first and second directions to allow the heat exchange media having different average temperatures to respectively circulate in the first-and-second direction heat exchange portions. In the drawings, the first and second directions are shown as the up and down directions. However, the present invention is not limited thereto, and for example, the first and second directions may be left and right directions. In addition, when a direction in which outside air blows in is referred to as the front direction and a direction in which the outside air blows out is referred to as the rear direction, in the heat exchanger 1000, an inner space of the tube 200 may be partitioned and separated into the front and rear sides to have the heat exchange portion double-formed in the front and rear directions. The tube 200 may be an extruded tube manufactured using the extrusion method through a mold, or a folded tube including a partition wall partitioning and separating the inner space of the tube 200 into the front and rear sides by bending a plate. In addition, for example, the heat exchanger 1000 may be a radiator in which high-temperature coolant/low-temperature coolant circulates.

Figure 2:
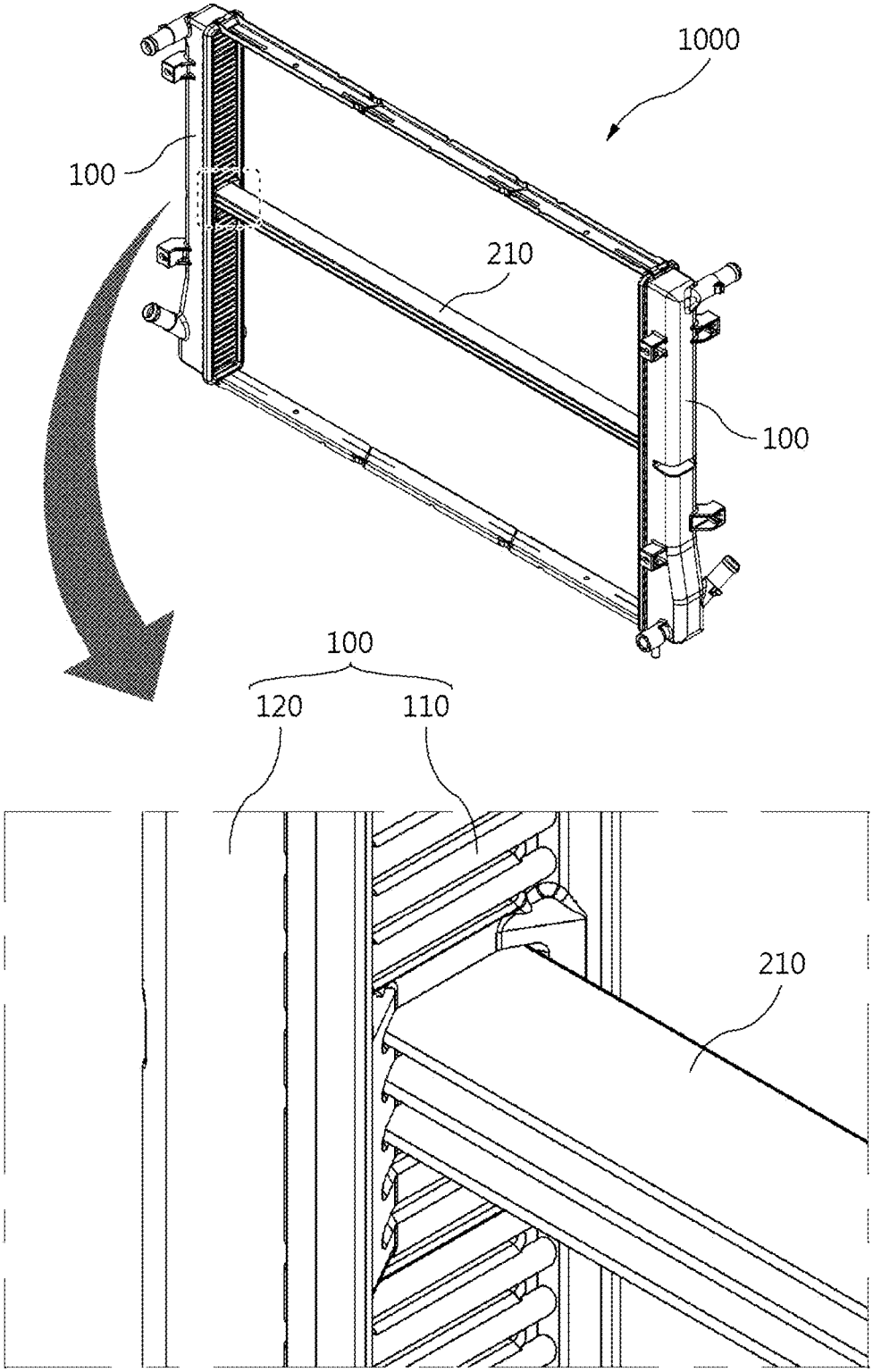
FIG. 2 is an exploded perspective view of the conventional integrated heat exchanger in which two types of heat exchange media circulate.

FIG. 2 is an exploded perspective view of the conventional integrated heat exchanger in which two types of heat exchange media circulate. FIG. 2 is a view for showing in detail that the heat exchange portion is partitioned in the first and second directions (up and down directions when viewed with reference to FIG. 2) and omits the tube 200 or the fin 300 except for a dummy tube 210 for convenience. The dummy tube may be a tube having the same external shape as a general tube to be smoothly inserted into a tube insertion hole of the header, and blocked without having a circulation path through which a heat exchange medium can circulate unlike the general tube. The tube 200 may serve to allow the heat exchange media to circulate between the pair of header tanks 100, and the heat exchange media may not circulate between the pair of header tanks 100 at a point where the dummy tube 210 is positioned. Therefore, in order to form the first-and-second direction heat exchange portions, the inner space of the header tank 100 may only need to be partitioned and separated in the first and second directions at the point where the dummy tube 210 is positioned. As a result, a boundary point of the first-and-second direction heat exchange portions may be defined as the point where the dummy tube 210 is positioned.

As such, in the heat exchanger 1000, the inner space of the header tank 100 may be partitioned and separated in the first and second directions. To this end, the tank 120 may include a separation structure for partitioning and separating the inner space of the header tank 100 at the boundary point of the first-and-second direction heat exchange portions in the first and second directions. The separation structure may be a separation baffle having one end fixed to an inner surface of the tank 120 and the other end in contact with the dummy tube 210, or a separation rib formed by a portion of the tank 120 protruding into the header tank 100 and an end of the protrusion in contact with the dummy tube 210, as shown in FIG. 2.

Figure 3:
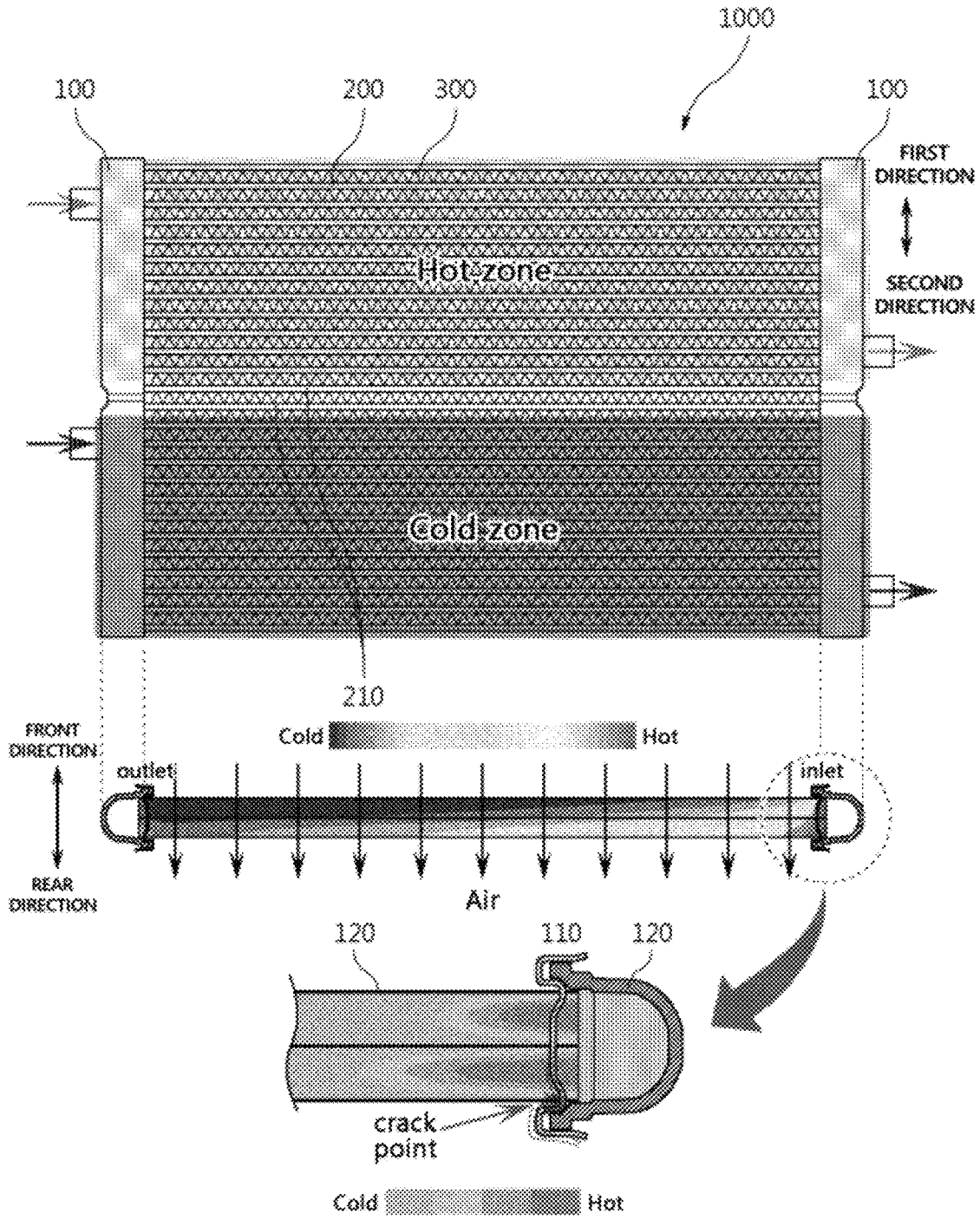
FIG. 3 is an example of temperature distribution unbalance in the heat exchanger.

FIG. 3 specifically shows an example of temperature distribution unbalance in the heat exchanger. For example, as shown in the upper portion of FIG. 3, an upper heat exchange portion of the heat exchanger 1000 may have a high temperature zone (i.e., hot zone), and a lower heat exchange portion of the heat exchanger 1000 may have a low temperature zone (i.e., cold zone).

As such, when a temperature difference occurs between the first-and-second direction heat exchange portions, thermal stress may be concentrated on the boundary point of the first-and-second direction heat exchange portions due to a difference in an amount of thermal deformation in the first-and-second direction heat exchange portions.

The middle portion of FIG. 3 shows a top view of the heat exchanger 1000 and a temperature distribution graph. The temperature distribution graph clearly shows that the heat exchange medium flows from an inlet of the tube 200 to an outlet thereof, exchanges heat with outside air, and gradually has a lower temperature. In this regard, as seen here, the temperature of the rear side of the tube 200 may generally be higher than that of the front side of the tube 200. That is, it can be seen that the heat exchange medium circulating to an inner space of the front side of the tube 200 is cooled better than the heat exchange medium circulating to an inner space of the rear side of the tube 200. The lower portion of FIG. 3 shows the temperature distribution graph displayed in more detail at the inlet portion of the tube 200. Here, it can also be seen that an overall temperature of the rear side of the tube is higher than that of the front side thereof, and the cooling of the heat exchange medium is not sufficiently performed.

This temperature distribution unbalance phenomenon is described in more detail as follows. The heat exchange medium circulating to the inner space of the front side of the tube 200 may first exchange heat with air. As described above, when the heat exchanger 1000 is the radiator, air may have a lower temperature than the heat exchange medium, and heat of the heat exchange medium may thus be discharged to air, thereby increasing the temperature of air. The heat exchange medium circulating to the inner space of the rear side of the tube 200 may exchange heat with air having a temperature already increased slightly in the front side thereof as described above. Therefore, the heat of the heat exchange medium in the rear side of the tube may not be smoothly discharged to air compared to that in the front side of the tube, and the heat exchange medium may be cooled less, such that the overall temperature of the rear side of the tube 200 may be higher than that of the front side thereof.

As such, when the rear side of the tube 200 has the increased temperature, a corresponding portion may have an increased amount of thermal deformation. The lower portion of FIG. 3 shows, by a dotted line, a state where more thermal deformation occurs at the rear side of the header 110 combined to the rear side of the tube 200 than the front side thereof due to the temperature distribution unbalance. In general, the tube 200 may be brazed after being inserted into the tube insertion hole of the header 110. Here, as indicated by the dotted line, when the rear side of the header 110 is relatively stretched excessively due to the thermal deformation, the thermal stress may be excessively concentrated on this junction, and crack of the heat exchanger may eventually occur.

That is, in short, in the case of the heat exchanger double-formed in both the first and second directions and the front and rear directions, the thermal stress may be concentrated in a vicinity of the boundary point of the first-and-second direction heat exchange portions in the first and second directions, and the thermal stress may be concentrated on a header-tube junction of the rear side in the front and rear directions. In conclusion, it can be seen that the most thermal stress is concentrated on the header-tube junction of the rear side, positioned near the boundary point of the first-and-second direction heat exchange portions.

In the present invention, in order to solve this problem, a flow of the heat exchange medium circulating to the inner space of the rear side of the tube 200 may be relatively less than a flow of the heat exchange medium circulating to the inner space of the front side of the tube 200. As described above, a major cause of the thermal deformation unbalance is that the heat exchange medium circulating to the inner space of the front side of the tube 200 may first exchange heat with air, thereby increasing the temperature of air, and air having the increased temperature may not sufficiently absorb heat from the heat exchange medium circulating to the inner space of the rear side of the tube 200. Here, when the flow of the heat exchange medium circulating to the inner space of the rear side of the tube 200 is reduced, an amount of heat that air needs to absorb from the heat exchange medium of the rear side of the tube may be reduced. That is, when the flow of the heat exchange medium circulating to the inner space of the rear side of the tube 200 is reduced, even if air does not absorb as much heat as in the inner space of the front side thereof, sufficient heat may be absorbed enough to lower the temperature of the heat exchange medium of the rear side. The present invention uses this principle, and the present invention may suggest a flow distribution structure formed in the tank 120 so that the flow of the heat exchange medium in the rear side is less than in the front side.

Figure 4:
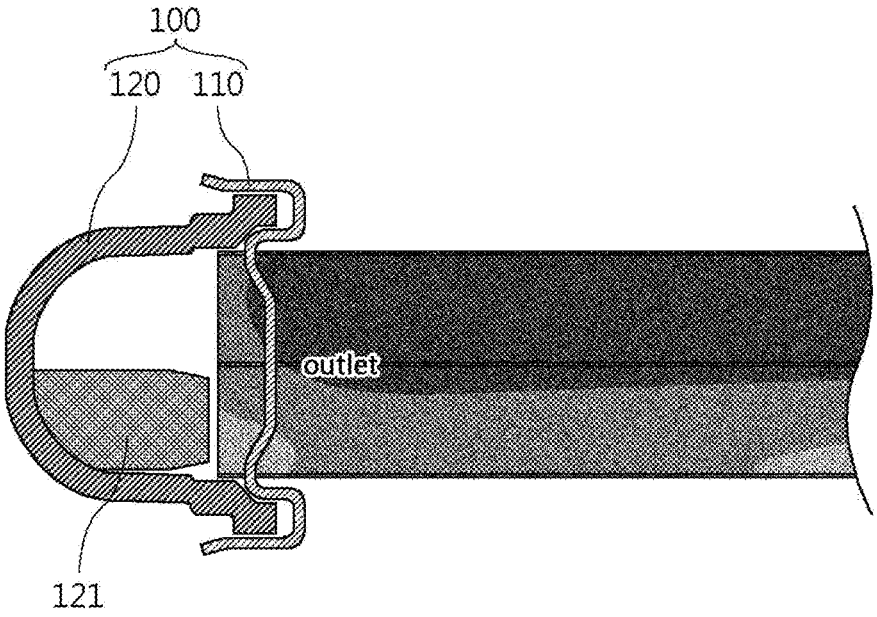
FIG. 4 shows a first exemplary embodiment of the flow distribution structure for thermal stress dispersion of the present invention.

FIG. 4 shows a first exemplary embodiment of the flow distribution structure for thermal stress dispersion of the present invention. In the first exemplary embodiment, the flow distribution structure may be a flow adjustment baffle 121 extending in a height direction of the header tank 100 and having one end fixed to the inner surface of the tank 120 and the other end spaced apart from the inner space of the rear side of the tube 200 to reduce the flow of the heat exchange medium circulating to the inner space of the rear side of the tube 200. FIG. 4 is the top view and shows that the other end of the flow adjustment baffle 121 is spaced apart from a rear end of the tube 200 by a predetermined distance, and the present invention is not limited thereto. For example, the other end of the flow adjustment baffle 121 may extend to the inner space of the tube 200. In this case, an outer diameter of the other end of the flow adjustment baffle 121 may be slightly smaller than an inner diameter of the tube 200. That is, in this case, the other end of the flow adjustment baffle 121 may be fitted in the inner space of the tube 200 while having a small gap, and may reduce an area of the flow path itself in this way to also reduce the flow.

Figure 5:
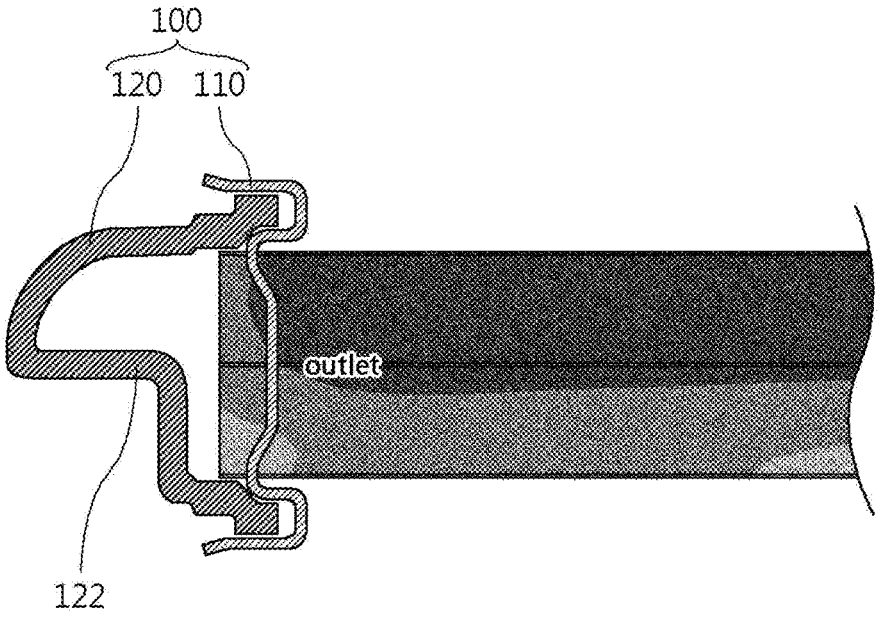
FIG. 5 shows a second exemplary embodiment of the flow distribution structure for thermal stress dispersion of the present invention.

FIG. 5 shows a second exemplary embodiment of the flow distribution structure for thermal stress dispersion of the present invention. In the second exemplary embodiment, the flow distribution structure may be a flow adjustment rib 122 formed by a portion of the tank 120 protruding into the header tank 100 in the height direction of the header tank 100 and an end of the protrusion spaced apart from the inner space of the rear side of the tube 200 to reduce the flow of the heat exchange medium circulating to the inner space of the rear side of the tube 200. An actual shape of the flow adjustment rib 122 may be, for example, similar to that of the separation rib shown in FIG. 2. However, the separation rib may block both the front and rear sides of the tube 200, whereas the flow adjustment rib 122 may be formed only on the rear side of the tube 200. In addition, the separation rib may completely block the circulation of the heat exchange medium, whereas the flow adjustment rib 122 may reduce the flow by reducing the area of the flow path while leaving a small gap through which the heat exchange medium can circulate.

Figure 6A:
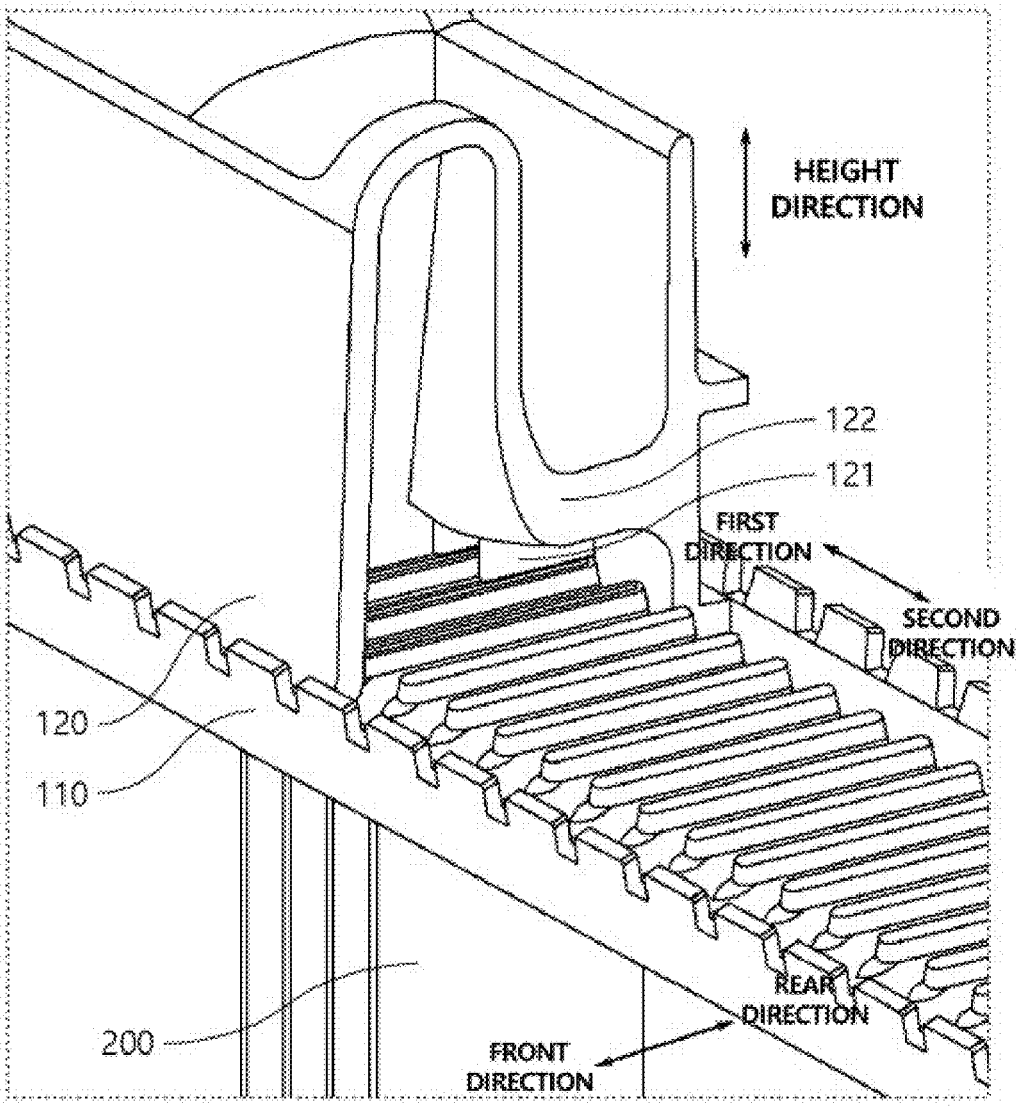
FIGS. 6A to 7 each show a third exemplary embodiment of the flow distribution structure for thermal stress dispersion of the present invention.
Figure 6B:
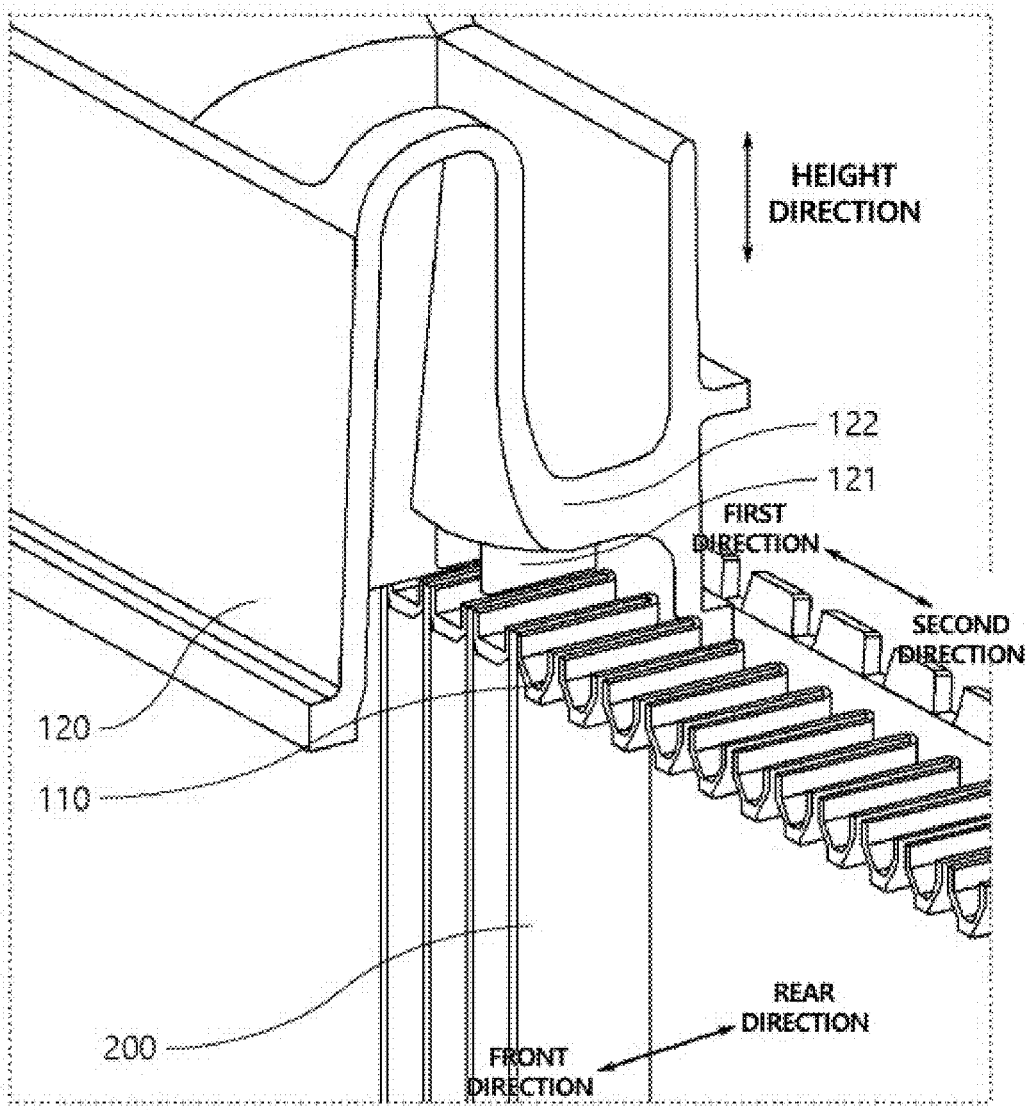
Figure 6C:
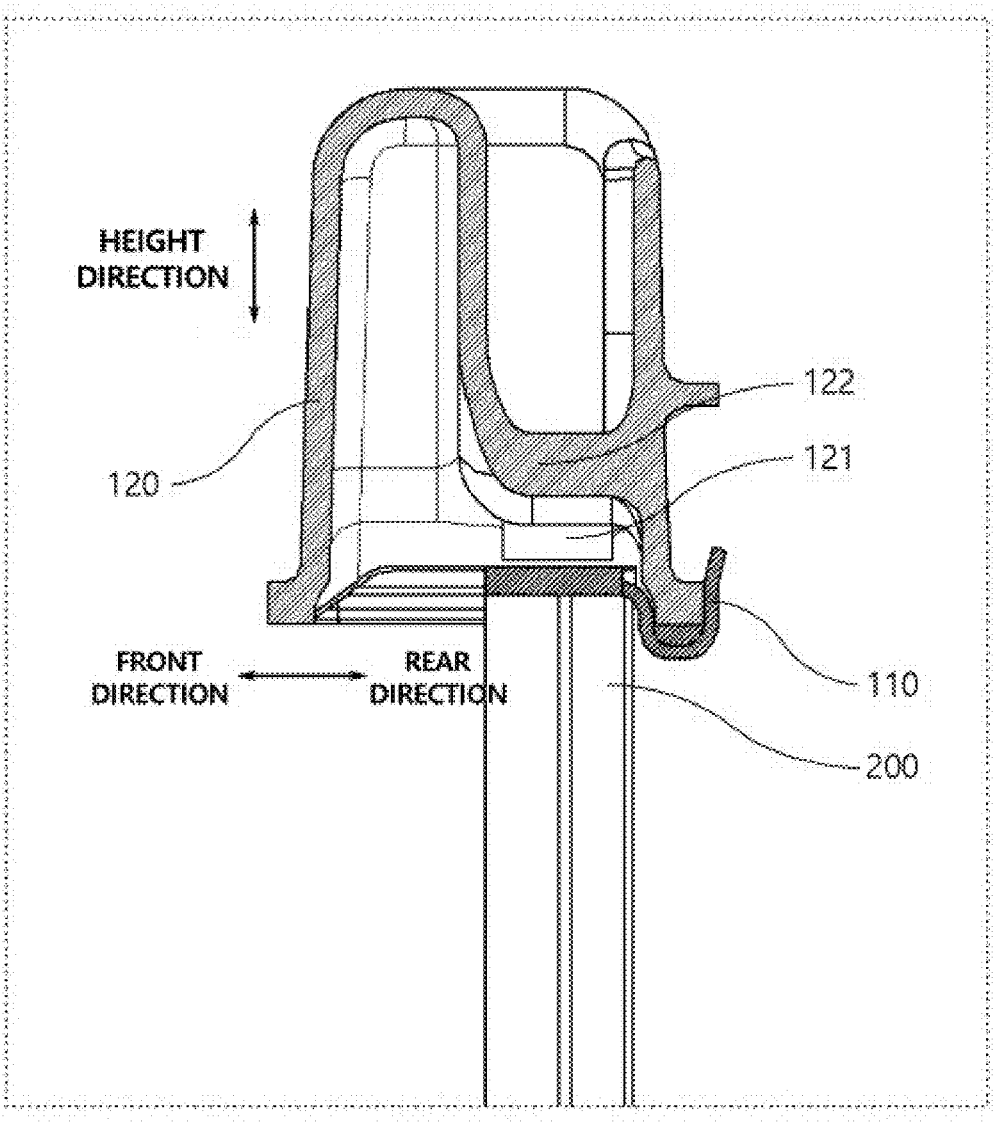
Figure 6D:
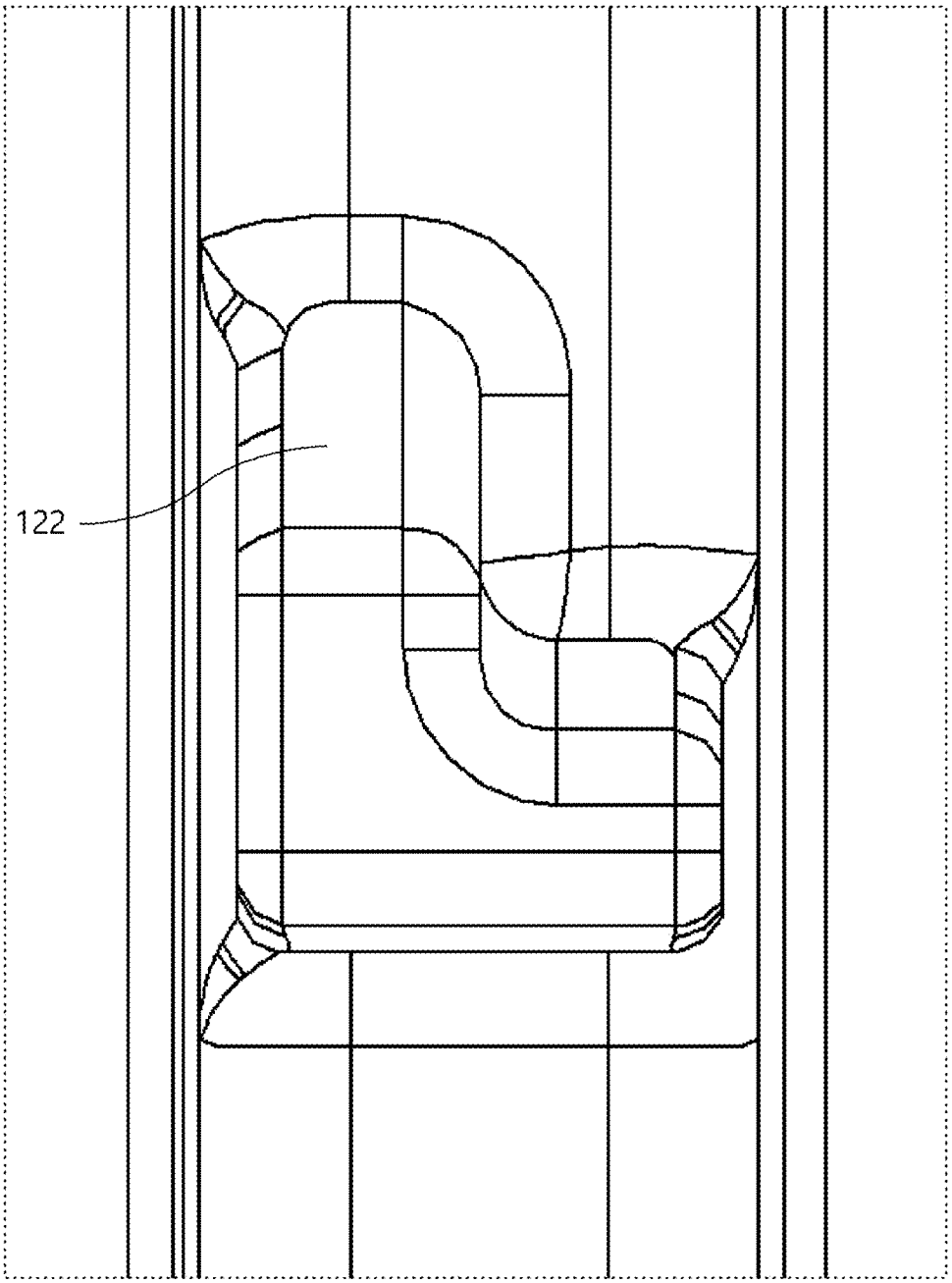
Figure 6E:
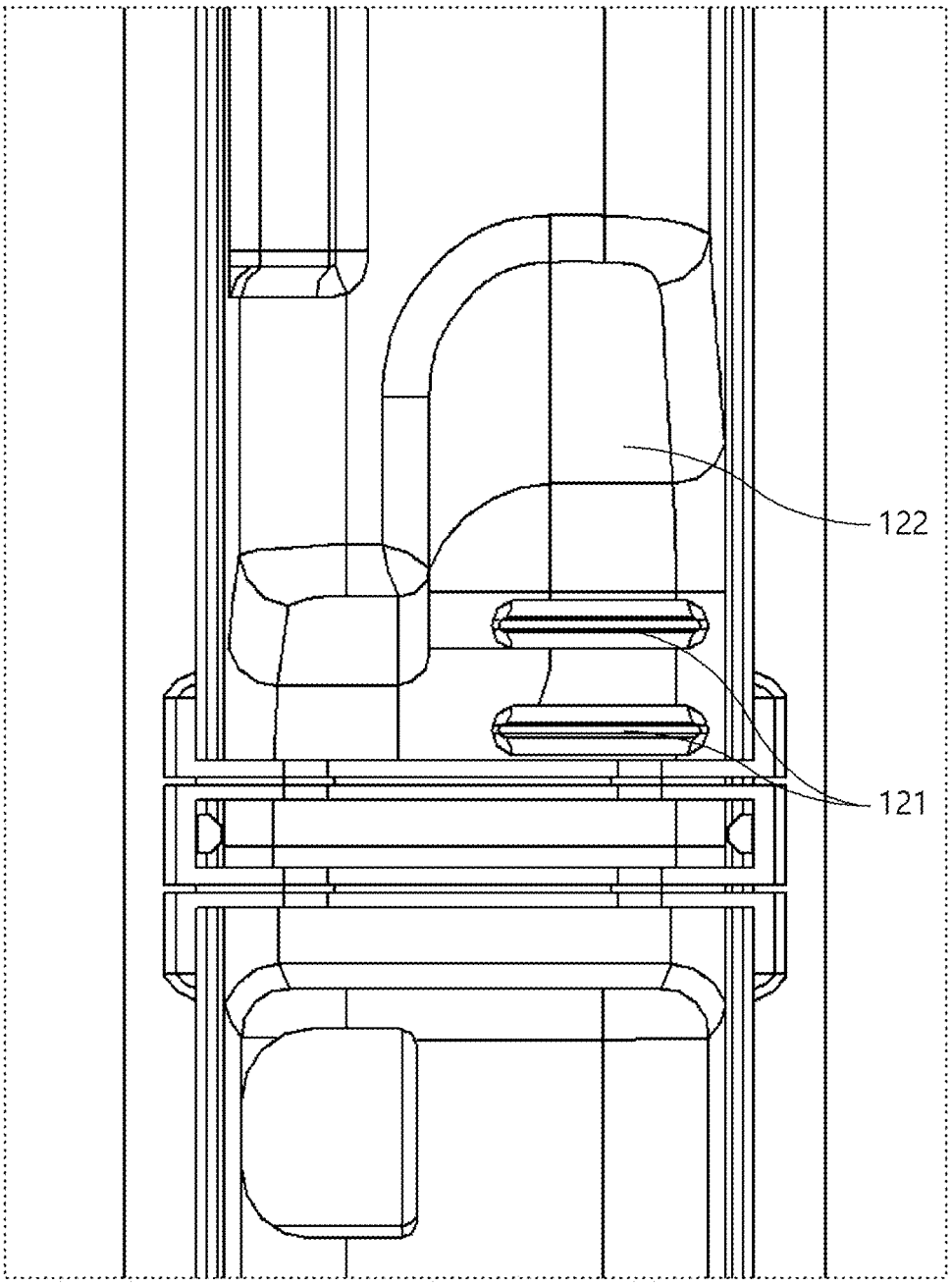
Figure 6F:
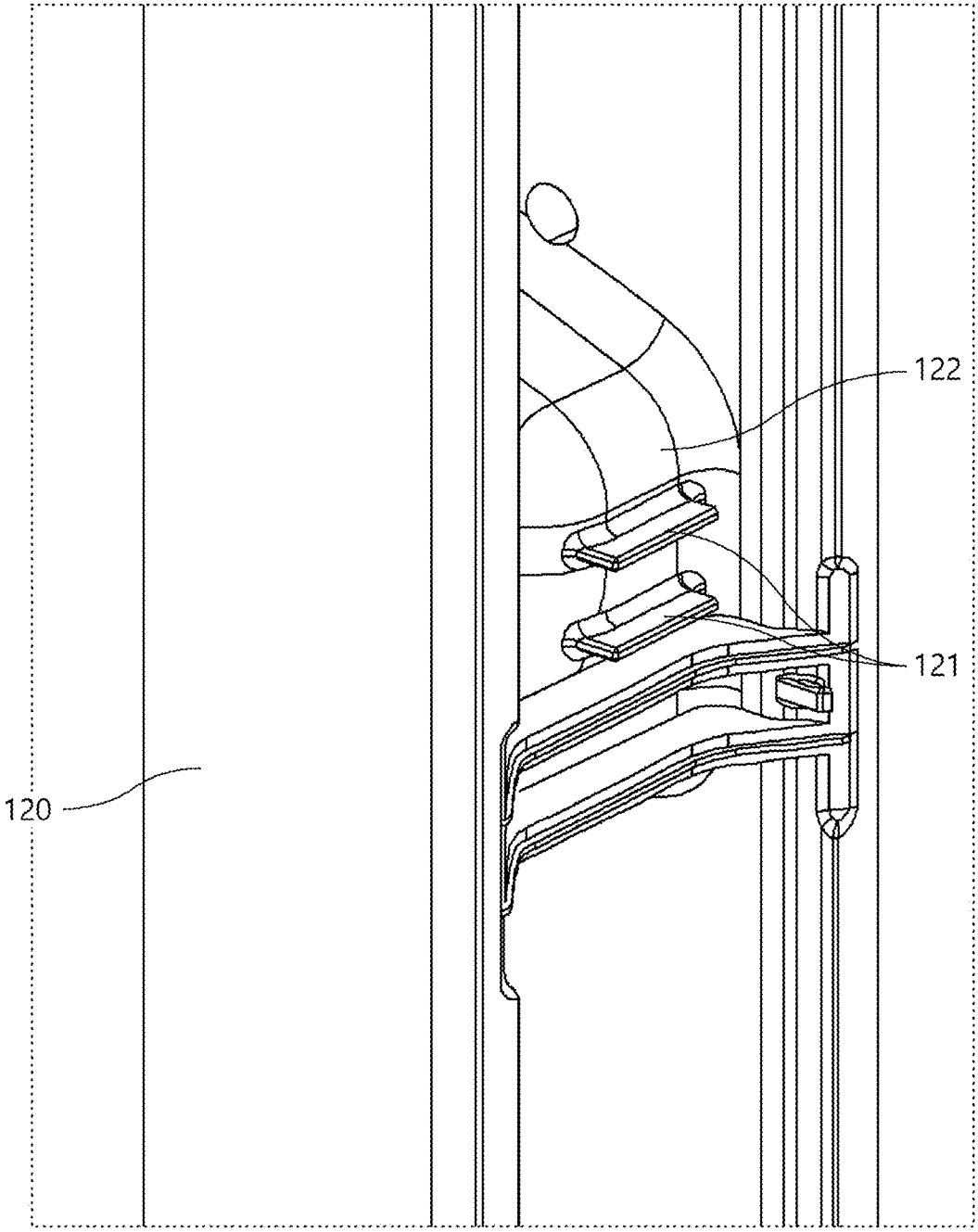
Figure 7:
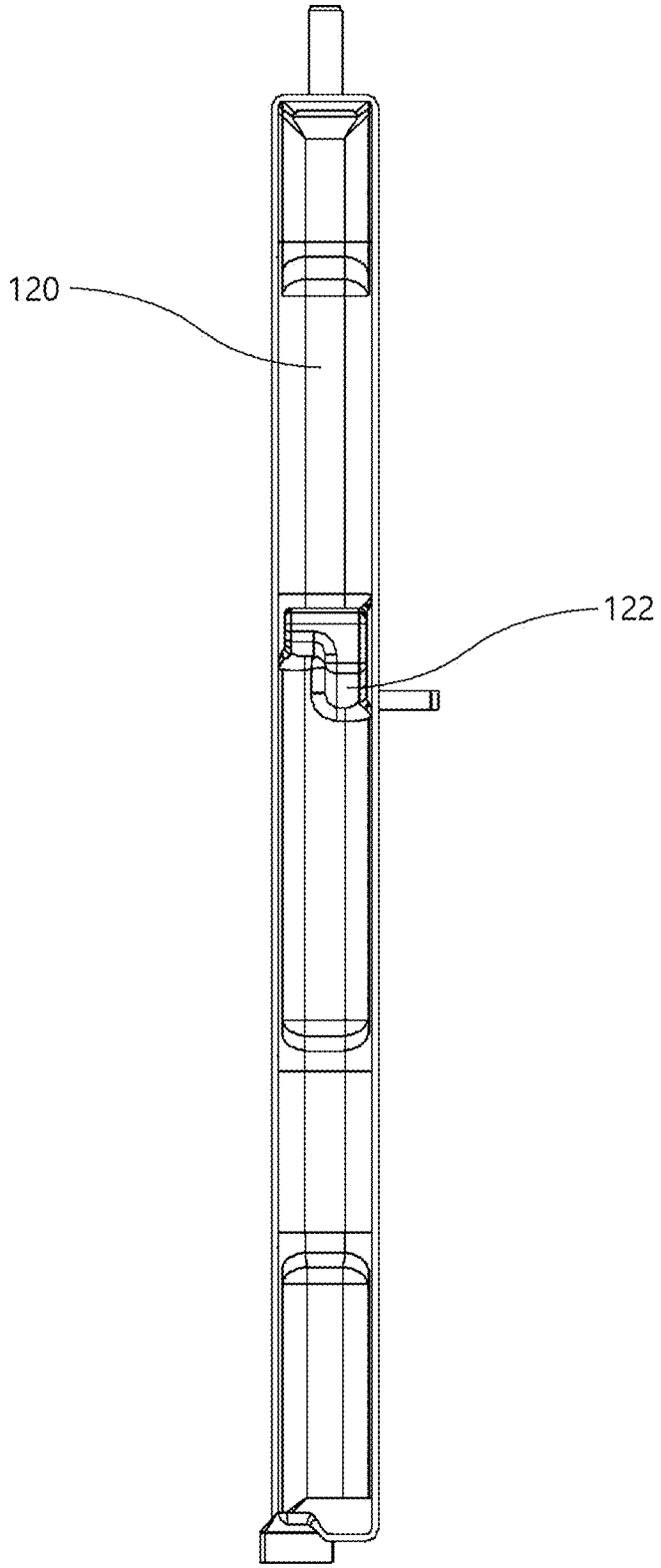

FIGS. 6A to 7 each show a third exemplary embodiment of the flow distribution structure for thermal stress dispersion of the present invention. To briefly summarize the third exemplary embodiment, it can be considered that the flow adjustment baffle 121 of the first exemplary embodiment and the flow adjustment rib 122 of the second exemplary embodiment described above are combined to each other. That is, in the third exemplary embodiment, the flow distribution structure may be a combination of the flow adjustment rib 122 and the flow adjustment baffle 121, which may reduce the flow of the heat exchange medium circulating to the inner space of the rear side of the tube 200 by including the flow adjustment rib 122 formed by a portion of the tank 120 protruding into the header tank 100 in the height direction of the header tank 100, and the end of the protrusion spaced apart from the inner space of the rear side of the tube 200 and the flow adjustment baffle 121 extending in the height direction of the header tank 100 and having one end fixed to the inner surface of the flow adjustment rib 122 and the other end spaced apart from the inner space of the rear side of the tube 200.

A perspective view of FIG. 6A shows the header 110 as it is and the tank 120 cut at its portion where the flow distribution structure is positioned, and only a portion of the tube 200, in which the flow distribution structure is positioned. A perspective view of FIG. 6B shows that a front half of a combination of the header 110 and the tube 200 is cut, and may correspond to a cross-sectional view of FIG. 6C. FIG. 6C is the cross-sectional view showing the same view as in FIGS. 4 and 5, in which the flow adjustment rib 122 protrudes to the vicinity of a rear inlet of the tube 200, and the flow adjustment rib 122 further extends from the inner surface of the flow adjustment rib 122 and protrudes to a position where the flow adjustment rib 122 almost meets the rear inlet of the tube 200. The flow of the heat exchange medium circulating to the inner space of the rear side of the tube 200 can be very effectively reduced by including the flow distribution structure formed as above.

In the third exemplary embodiment, the flow distribution structure may include both the flow adjustment rib 122 and the flow adjustment baffle 121. Here, the number of the tubes 200 in which the flow is reduced by the flow adjustment baffle 121 may be less than or equal to the number of the tubes 200 in which the flow is reduced by the flow adjustment rib 122. Meanwhile, FIG. 6A and the like show an example in which the number of the tubes 200 in which the flow is reduced by the flow adjustment baffle 121 is less than the number of the tubes 200 in which the flow is reduced by the flow adjustment rib 122. In this case, when the flow adjustment baffle 121 is positioned far from the separation structure, an empty space between the flow adjustment baffle 121 and the separation structure may become a substantial dead zone in which the heat exchange medium does not properly circulate and is pooled, which may cause a waste of space in the heat exchanger. Therefore, it may be preferable that the flow adjustment baffle 121 is positioned adjacent to the separation structure as shown in the drawings.

Meanwhile, the description describes above that the tank 120 may include the separation structure for partitioning and separating the inner space of the header tank 100 at the boundary point of the first-and-second direction heat exchange portions in the first and second directions, and the separation structure may be the separation rib or the separation baffle. FIG. 6D is a view of the flow distribution structure viewed from the outside of the tank 120, and FIG. 6E is a view of the flow distribution structure viewed from the inside of the tank 120. In addition, FIG. 6F is a perspective view of the flow distribution structure viewed from the inside of the tank 120. FIGS. 6A to 6F above show an example in which the flow distribution structure includes the flow adjustment rib 122, and the separation structure is the separation rib. In this case, when the flow adjustment rib 122 and the separation rib are formed independently of each other, not only may the space between the ribs become the dead zone, but also a deformation of the tank 120 may occur too rapidly in the space between the ribs. Accordingly, a defect such as the crack of the heat exchanger may occur during a manufacturing process. Therefore, as shown in FIGS. 6A to 6F, when the flow distribution structure includes the flow adjustment rib 122, and the separation structure is the separation rib, it may be preferable that the flow adjustment rib 122 and the separation rib are connected to each other.

Meanwhile, the flow distribution structure may be positioned anywhere adjacent to the inlet of the tube 200, into which the heat exchange medium is introduced or the outlet of the tube 200, from which the heat exchange medium is discharged. However, when the flow distribution structure is positioned adjacent to the inlet of the tube 200, the high-temperature heat exchange medium accommodated in the header tank 100 may not smoothly escape into the tube 200. This position may cause a lower heat exchange performance by unnecessarily increasing a pressure in the header tank 100 or by not allowing the heat exchange medium to smoothly flow into the tube 200. Therefore, as shown as the 'outlet' in both FIGS. 4 and 5, the flow distribution structure may preferably be positioned adjacent to a portion of the tube, through which the heat exchange medium is discharged. In this way, it is possible to sufficiently secure fluidity of the heat exchange medium in the middle portion of the tube 200, and simultaneously, to effectively disperse the thermal stress at a crack point of the rear end of the tube 200, on which the thermal stress is concentrated.

In addition, the flow distribution structure may be positioned in any position of the tube 200. As long as the tube 200 has the two rows, i.e. the front and rear sides, the concentration of the thermal stress on header-tube junction of the rear side as described above may occur in any position of the tube 200. Therefore, the flow distribution structure may be positioned in any position of the tube 200.

However, when the flow distribution structure is positioned in any position of the tube 200 as such, the heat exchange media may not smoothly circulate substantially from the tube 200 to the header tank 100 positioned adjacent to the outlet, which may lead to the lower heat exchange performance of the heat exchanger 1000. Here, as also described above, another portion on which the thermal stress is concentrated may be the boundary point of the first-and-second direction heat exchange portions. In consideration of this point, the flow distribution structure may be positioned in a certain position of the tube 200 in the vicinity of the boundary point of the first-and-second direction heat exchange portions. Here, the vicinity of the boundary point of the first-and-second direction heat exchange portions may range from one to five positions with respect to the dummy tube 210, positioned in the boundary point of the first-and-second direction heat exchange portions of the heat exchanger 1000, in the first and second directions. FIG. 7 shows an example in which the flow distribution structure of the third exemplary embodiment as previously shown in FIGS. 6A to 6F is positioned in a portion of the tube 200, in the vicinity of the boundary point of the first-and-second direction heat exchange portions. In this case, it is possible to properly prevent the lower heat exchange performance of the entire heat exchanger 1000, and simultaneously, to effectively disperse the thermal stress at the point at which the concentration of the thermal stress occurs the most. However, the present invention is not limited thereto, and when a point at which the thermal stress is concentrated is found during an actual operation of the heat exchanger, the flow distribution structure may be locally positioned in the corresponding portion.

As described above, in the present invention, it is possible to reduce the flow of the heat exchange medium circulating to the inner space of the rear side of the tube, thereby reducing the amount of heat air that already exchanged heat once in the front side needs to absorb from the rear side (to sufficiently cool the heat exchange medium). Accordingly, the heat exchange medium of the rear side can be sufficiently and appropriately cooled even when air does not absorb as much heat as in the front side. In other words, the temperature of the heat exchange medium in the front side and the temperature of the heat exchange medium in the rear side can be matched to each other much more uniformly. It is thus possible to significantly reduce a risk of the crack occurring due to the thermal stress concentrated on the header-tube junction of the rear side by making the temperature distribution of the front side and that of the rear side uniform.

In addition, it is known that the thermal stress may also be concentrated on the boundary point of the first-and-second direction heat exchange portions. Therefore, it is possible to sufficiently reduce the risk of the crack occurring due to the concentration of the thermal stress while properly maintaining the overall heat exchange performance of the heat exchanger by locally positioning the flow distribution structure in the vicinity of the boundary point of the first-and-second direction heat exchange portions.

The present invention is not limited to the abovementioned exemplary embodiments, and may be variously applied. In addition, the present invention may be variously modified by those skilled in the art to which the present invention pertains without departing from the gist of the present invention claimed in the claims.

INDUSTRIAL APPLICABILITY

According to the present invention, the integrated heat exchanger for cooling two types of heat exchange media having different temperatures may have the flow distribution structure formed in the tank to effectively disperse the thermal stress caused by the temperature difference. As a result, it is possible to effectively disperse the thermal stress, and ultimately significantly reduce damage and crack problems in the connection between the header and the tube.

The invention claimed is:

1. A heat exchanger comprising a pair of header tanks each including a header and a tank, and positioned in parallel to each other while being spaced apart from each other by a predetermined distance; and a plurality of tubes each having each end fixed to a header tank of the pair of header tanks to form a flow path of a refrigerant, wherein when a direction in which outside air blows in is referred to as a front direction and a direction in which the outside air blows out is referred to as a rear direction, and when one of an extension direction of the header tank is referred to as a first direction and another of an extension direction of the header tank is referred to as a second direction, in the heat exchanger, an inner space of the header tank is partitioned and separated in the first and second directions to allow heat exchange media having different average temperatures to respectively circulate in first-and-second direction heat exchange portions, and an inner space of a tube of the plurality of tubes is partitioned and separated into front and rear sides to have a heat exchange portion in a front direction and a heat exchange portion in the rear direction, and a flow distribution structure is positioned in each tank of the pair of header tanks for a flow of a heat exchange medium circulating to an inner space of a rear side of the tube to be less than a flow of a heat exchange medium circulating to an inner space of a front side of the tube, wherein the flow distribution structure is a combination of a flow adjustment rib and a flow adjustment baffle for reducing the flow of the heat exchange medium circulating to the inner space of the rear side of the tube by including the flow adjustment rib formed by a portion of the tank protruding into the header tank in a height direction of the header tank and an end of the protrusion spaced apart from the inner space of the rear side of the tube, and the flow adjustment baffle extending in the height direction of the header tank and having one end fixed to an inner surface of the flow adjustment rib and the other end spaced apart from the inner space of the rear side of the tube, wherein in the flow distribution structure, a number of the tubes in which flow is reduced by the flow adjustment baffle is less than or equal to a number of the tubes in which flow is reduced by the flow adjustment rib.

2. The heat exchanger of claim 1, wherein the flow distribution structure is a separation structure for partitioning and separating the inner space of the header tank at a boundary point of the first-and-second direction heat exchange portions of the tank in the first and second directions, the number of the tubes in which the flow is reduced by the flow adjustment baffle is less than the number of the tubes in which the flow is reduced by the flow adjustment rib, and the flow adjustment baffle is positioned adjacent to the separation structure.

3. The heat exchanger of claim 2, wherein the tank includes the separation structure for partitioning and separating the inner space of the header tank at the boundary point of the first-and-second direction heat exchange portions in the first and second directions, and the separation structure is either a separation rib formed by a portion of the tank protruding into the header tank in the height direction of the header tank and the end of the protrusion in contact with the tube, or a separation baffle extending in the height direction of the header tank and having one end fixed to the inner surface of the tank and another end in contact with the tube.

4. The heat exchanger of claim 3, wherein when the flow distribution structure includes the flow adjustment rib, and the separation structure is the separation rib, the flow adjustment rib and the separation rib are connected to each other.

5. The heat exchanger of claim 1, wherein the flow distribution structure is positioned adjacent to a portion of the tube, through which the heat exchange medium is discharged.

6. The heat exchanger of claim 2, wherein the flow distribution structure is positioned in any position of the tube or is positioned in a certain position of the tube in a vicinity of the boundary point of the first-and-second direction heat exchange portions.

7. The heat exchanger of claim 6, wherein the flow distribution structure is positioned in a vicinity of the boundary point of the first-and-second direction heat exchange portions, and wherein the heat exchanger comprises a dummy tube, and the vicinity of the boundary point of the first-and-second direction heat exchange portions ranges from one to five positions with respect to the dummy tube, which is positioned in the boundary point of the first-and-second direction heat exchange portions of the heat exchanger, in the first and second directions.

8. The heat exchanger of claim 1, wherein the tube includes a partition wall partitioning and separating the inner space of the tube into the front and rear sides by bending a plate.

9. The heat exchanger of claim 1, wherein the heat exchanger is a radiator in which high-temperature coolant and low-temperature coolant circulate.

* * * * *